US006137520A

United States Patent [19]

Kashiwaya et al.

[11] Patent Number: 6,137,520

[45] Date of Patent: Oct. 24, 2000

[54] THERMAL HEAD

[75] Inventors: Makoto Kashiwaya; Junichi Yoneda; Taihei Noshita, all of Kanagawa, Japan

[73] Assignee: Fuji Photo Film Co., Ltd., Kanagawa, Japan

[21] Appl. No.: 09/118,002

[22] Filed: Jul. 17, 1998

[30] Foreign Application Priority Data

Jul. 17, 1997 [JP] Japan ..... 9-192226

[51] Int. Cl.[7] ..... B41J 2/335

[52] U.S. Cl. ..... 347/203

[58] Field of Search ..... 347/200, 203

[56] References Cited

FOREIGN PATENT DOCUMENTS

| | | | |
|---|---|---|---|
| 0 498 400 A1 | 2/1992 | European Pat. Off. . | |
| 61-121966 | 6/1986 | Japan | 347/203 |
| 61-53955 | 11/1986 | Japan | B41J 3/20 |
| 4-62866 | 10/1992 | Japan | B41J 2/335 |
| 5-8418 | 1/1993 | Japan | 347/203 |
| 6-036210 | 2/1994 | Japan | 347/203 |
| 7-132628 | 5/1995 | Japan | B41J 2/335 |

OTHER PUBLICATIONS

Patent Abstract of JP 06036210, dated Feb. 10, 1994.
Patent Abstract of JP 63197665, dated Aug. 16, 1988.
Patent Abstract of JP 10034989, dated Feb. 10, 1998.
Patent Abstract of JP 07132628, dated May 23, 1995.
Patent Abstract of JP 62095245, dated May 1, 1987.

*Primary Examiner*—Huan Tran
*Attorney, Agent, or Firm*—Sughrue, Mion, Zinn, Macpeak & Seas, PLLC

[57] ABSTRACT

The improved thermal head has a protective film of a heater formed on the heater, the protective film comprising a ceramic-based lower protective layer composed of at least one sub-layer, an intermediate protective layer also composed of at least one sub-layer and formed on the lower protective layer, and a carbon-based upper protective layer formed on the intermediate protective layer. The thermal head of the invention has a protective film which has significantly reduced corrosion and wear, which is advantageously protected from cracking and peeling due to heat and mechanical impact and which allows the thermal head to have a sufficient durability to ensure that the thermal recording of high-quality images is consistently performed over an extended period of operation.

5 Claims, 3 Drawing Sheets

THERMAL HEAD

BACKGROUND OF THE INVENTION

This invention relates to the art of thermal heads for thermal recording which are used in various types of printers, plotters, facsimile, recorders and the like as recording means.

Thermal materials comprising a thermal recording layer on a substrate of a film or the like are commonly used to record images produced in diagnosis by ultrasonic scanning (sonography).

This recording method, also referred to as thermal recording, eliminates the need for wet processing and offers several advantages including convenience in handling. Hence in recent years, the use of the thermal recording system is not limited to small-scale applications such as diagnosis by ultrasonic scanning and an extension to those areas of medical diagnoses such as CT, MRI and X-ray photography where large and high-quality images are required is under review.

As is well known, thermal recording involves the use of a thermal head having a glaze, in which heating elements comprising heaters and electrodes, used for heating the thermal recording layer of a thermal material to record an image are arranged in one direction (main scanning direction) and, with the glaze urged by small pressure against the thermal material (thermal recording layer), the two members are moved relative to each other in the auxiliary scanning direction perpendicular to the main scanning direction, and energy is applied to the heaters of the respective pixels in the glaze in accordance with image data to be recorded which were supplied from an image data supply source such as MRI or CT in order to heat the thermal recording layer of the thermal material, thereby accomplishing image reproduction.

A protective film is formed on the surface of the glaze of the thermal head in order to protect the heaters for heating a thermal material, the associated electrodes and the like. Therefore, it is this protective film that contacts the thermal material during thermal recording and the heaters heat the thermal material through this protective film so as to perform thermal recording.

The protective film is usually made of wear-resistant ceramics; however, during thermal recording, the surface of the protective film is heated and kept in sliding contact with the thermal material, so it will gradually wear and deteriorate upon repeated recording.

If the wear of the protective film progresses, density unevenness will occur on the thermal image or a desired protective strength can not be maintained and, hence, the ability of the film to protect the heaters is impaired to such an extent that the intended image recording is no longer possible (the head has lost its function).

Particularly in the applications such as the aforementioned medical use which require multiple gradation images of high quality, the trend is toward ensuring the desired high image quality by adopting thermal films with highly rigid substrates such as polyester films and also increasing the setting values of recording temperature (energy applied) and of the pressure at which the thermal head is urged against the thermal material. Under these circumstances, as compared with the conventional thermal recording, a greater force and more heat are exerted on the protective film of the thermal head, making wear and corrosion (or wear due to corrosion) more likely to progress.

With a view to preventing the wear of the protective film on the thermal head and improving its durability, a number of techniques to improve the performance of the protective film have been considered. Among others, a carbon-based protective film (hereinafter referred to as a carbon protective layer) is known as a protective film excellent in resistance to wear and corrosion.

Thus, Examined Published Japanese Patent Applications (KOKOKU) No. 61-53955 and No. 4-62866 (the latter being the divisional application of the former) disclose a thermal head excellent in wear resistance and response which is obtained by forming a very thin carbon protective layer having a Vickers hardness of 4500 kg/mm$^2$ or more as the protective film of the thermal head and a method of manufacturing the thermal head, respectively. The carbon protective layer has properties quite similar to those of diamond including a very high hardness and chemical stability, hence the carbon protective layer presents sufficiently excellent properties to prevent wear and corrosion which may be caused by the sliding contact with thermal materials.

The carbon protective layer is excellent in wear resistance, but brittle because of its hardness, that is, low in tenacity. Heat shock and thermal stress due to heating of heating elements may bring about rather easily cracking or peeling.

In order to resolve the problem, Unexamined Published Japanese Patent Application (KOKAI) No. 7-132628 discloses a thermal head which has a dual protective film comprising a lower silicon-based compound layer and an overlying diamond-like carbon layer, whereby the potential wear and breakage of the protective film due to heat shock are significantly reduced to ensure that high-quality images can be recorded over an extended period of time. In this document, the adhesion of the silicon-based compound layer to the diamond-like carbon layer is improved by subjecting the surface of the silicon-based compound layer to a surface treatment by plasma-assisted CVD or another technique in a reducing atmosphere.

However, the adhesion between the two layers is not enough to protect the protective film from cracking or peeling which may be caused by a stress due to a difference in coefficient of thermal expansion between the respective layers, a mechanical impact due to a foreign matter entered between the thermal material and the thermal head (glaze) during recording or other factors.

Cracking or peeling in the protective layer gives rise to wear, corrosion and wear due to corrosion, which results in reduction of the durability of the thermal head. The thermal head is not capable of exhibiting high reliability over an extended period of time.

SUMMARY OF THE INVENTION

The present invention has been accomplished under these circumstances and has as an object of providing a thermal head having a carbon-based protective layer which is significantly protected from corrosion and wear as well as cracking and peeling due to heat and mechanical impact, and which allows the thermal head to have a sufficient durability to ensure that the thermal recording of high-quality images is consistently performed over an extended period of operation.

In order to achieve the above object, the invention provides a thermal head having a protective film of a heater formed on said heater, said protective film comprising a ceramic-based lower protective layer composed of at least one sub-layer, an intermediate protective layer also composed of at least one sub-layer and formed on said lower protective layer, and a carbon-based upper protective layer formed on said intermediate protective layer.

Said intermediate protective layer is preferably based on at least one component selected from the group consisting of metals of the Groups IVA, VA and VIA, and Si and Ge.

It is preferred that said intermediate protective layer has a thickness of from 0.05 μm to 2 μm and that said upper protective layer has a thickness of from 0.5 μm to 5 μm.

It is also preferred that a surface of said lower protective layer is subjected to a lapping treatment and an etching treatment until said surface has a surface roughness value Ra of from 1 nm to 0.4 μm, before said intermediate protective layer is formed on said lower protective layer.

Said lower protective layer comprises preferably at least one of a nitride and a carbide.

DETAILED DESCRIPTION OF THE INVENTION

The thermal head of the invention will now be described in detail with reference to the preferred embodiments shown in the accompanying drawings.

Figure 1:
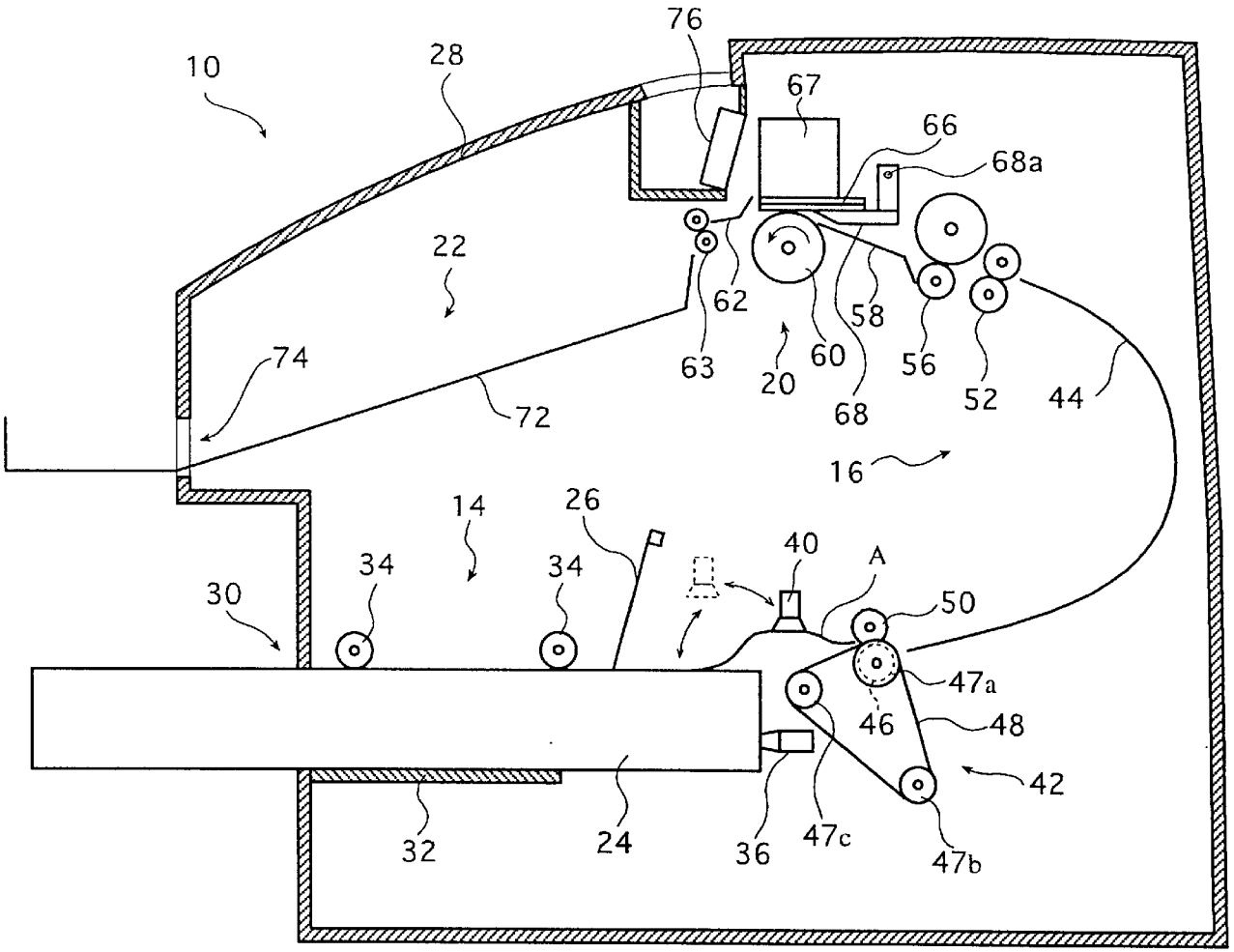
FIG. 1 shows the concept of an exemplary thermal recording apparatus using the thermal head of the invention.

FIG. 1 shows schematically an exemplary thermal recording apparatus using the thermal head of the invention.

The thermal recording apparatus generally indicated by 10 in FIG. 1 and which is hereinafter simply referred to as the "recording apparatus 10" performs thermal recording on thermal materials of a given size, say, B4 or 257 mm×364 mm (namely, thermal materials in the form of cut sheets, which are hereinafter referred to as "thermal materials A"). The apparatus comprises a loading section 14 where a magazine 24 containing thermal materials A is loaded, a feed/transport section 16, a recording section 20 performing thermal recording on thermal materials A by means of a thermal head 66, and an ejecting section 22.

In the thus constructed recording apparatus 10, a thermal material A is taken out of the magazine 24 and transported to the recording section 20, where the thermal material A against which the thermal head 66 is pressed is transported in the auxiliary scanning direction perpendicular to the main scanning direction in which the glaze extends (normal to the papers of FIGS. 1 and 2) and in the meantime, the individual heating elements are actuated in accordance with image data on the image to be recorded to perform thermal recording on the thermal material A.

The thermal material A comprises a substrate of a resin film such as a transparent polyethylene terephthalate (PET) film, a paper or the like which are overlaid with a thermal recording layer.

Typically, such thermal materials A are stacked in a specified number, say, 100 to form a bundle, which is either wrapped in a bag or bound with a band to provide a package. As shown, the specified number of thermal materials A bundled together with the thermal recording layer side facing down are accommodated in the magazine 24 of the recording apparatus 10, and they are taken out of the magazine 24 one by one to be used for thermal recording.

The magazine 24 is a case having a cover 26 which can be freely opened. The magazine 24 which contains the thermal materials A is loaded in the loading section 14 of the recording apparatus 10.

The loading section 14 has an inlet 30 formed in the housing 28 of the recording apparatus 10, a guide plate 32, guide rolls 34 and a stop member 36; the magazine 24 is inserted into the recording apparatus 10 via the inlet 30 in such a way that the portion fitted with the cover 26 is coming first; thereafter, the magazine 24 as it is guided by the guide plate 32 and the guide rolls 34 is pushed until it contacts the stop member 36, whereupon it is loaded at a specified position in the recording apparatus 10.

The loading section 14 is equipped with a mechanism (not shown) for opening or closing the cover 26 of the magazine.

The feed/transport section 16 has the sheet feeding mechanism using a sucker 40 for grabbing the thermal material A by application of suction, transport means 42, a transport guide 44 and a regulating roller pair 52 located in the outlet of the transport guide 44; thermal materials A are taken one by one out of the magazine 24 in the loading section 14 and transported to the recording section 20.

The transport means 42 comprises a transport roller 46, a pulley 47*a* coaxial with the transport roller 46, a pulley 47*b* coupled to a rotating drive source, a tension pulley 47*c*, an endless belt 48 stretched between the three pulleys 47*a*, 47*b* and 47*c*, and a nip roller 50 that pairs with the transport roller 46. The forward end of the thermal material A which has been sheet-fed by means of the sucker 40 is pinched between the transport roller 46 and the nip roller 50 such that the material A is transported.

When a signal for the start of recording is issued, the cover 26 is opened by the OPEN/CLOSE mechanism in the recording apparatus 10. Then, the sheet feeding mechanism using the sucker 40 picks up one sheet of thermal material A from the magazine 24 and feeds the forward end of the sheet to the transport means 42 (between the transport roller 46 and the nip roller 50). At the point of time when the thermal material A has been pinched between the transport roller 46 and the nip roller 50, the sucker 40 releases the material, and the thus fed thermal material A is supplied by the transport means 42 into the regulating roller pair 52 as it is guided by the transport guide 44.

At the point of time when the thermal material A to be used in recording has been completely ejected from the magazine 24, the OPEN/CLOSE mechanism closes the cover 26.

The distance between the transport means 42 and the regulating roller pair 52 which is defined by the transport guide 44 is set to be somewhat shorter than the length of the thermal material A in the direction of its transport. The forward end of the thermal material A first reaches the regulating roller pair 52 as the result of transport by the transport means 42. The regulating roller pair 52 are first at rest. The forward end of the thermal material A stops here and is subjected to positioning.

When the forward end of the thermal material A reaches the regulating roller pair 52, the temperature of the thermal head 66 (the glaze) is checked and if it is at a specified level, the regulating roller pair 52 starts to transport the thermal material A, which is transported to the recording section 20.

The recording section 20 has the thermal head 66, a platen roller 60, a cleaning roller pair 56, a guide 58, a heat sink 67 for cooling the thermal head 66, a cooling fan 76 and a guide 62.

The thermal head 66 is capable of recording on thermal sheets of up to, for example, B4 size at a recording (pixel) density of, say, about 300 dpi. Except for the protective film, the head has a known structure in that it has the glaze in which the heating elements performing thermal recording on the thermal material A are arranged in one direction, that is in the main scanning direction, and the cooling heat sink 67 is fixed to the thermal head 66. The thermal head 66 is supported on a support member 68 that can pivot about a fulcrum 68*a* in the up and down direction.

The glaze of the thermal head 66 will be later described in detail.

It should be noted that the thermal head 66 of the invention is not particularly limited in such aspects as the width (in the main scanning direction), resolution (recording density) and recording contrast; preferably, the head width ranges from 5 cm to 50 cm, the resolution is at least 6 dots/mm (ca. 150 dpi), and the recording contrast consists of at least 256 levels.

Figure 2:
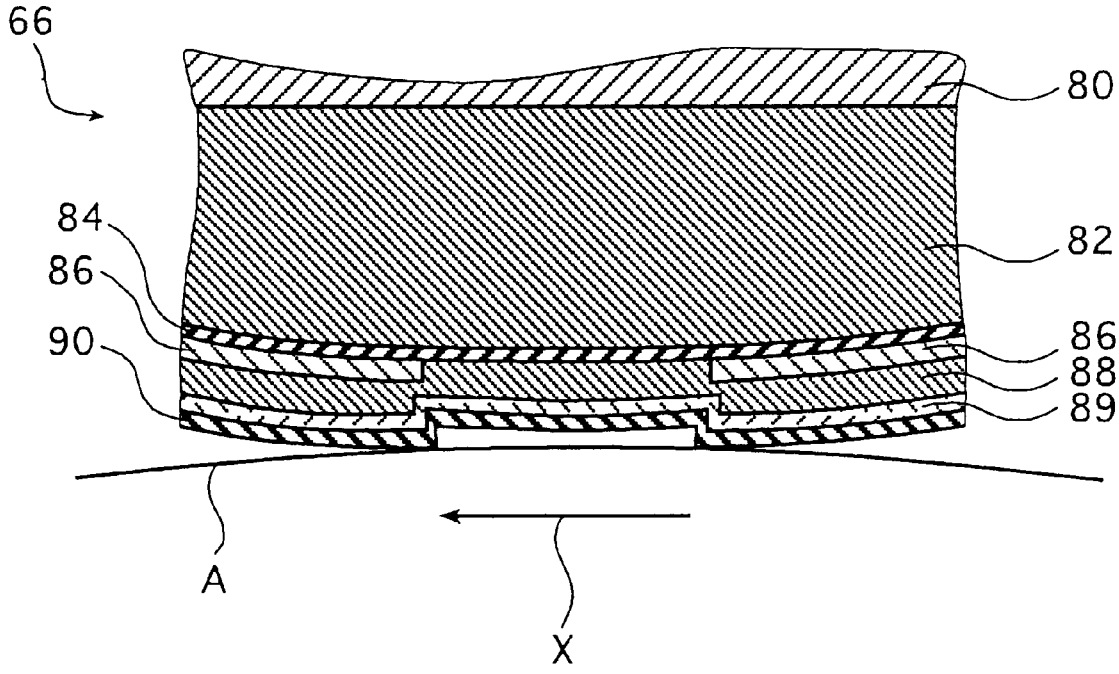
FIG. 2 is a schematic cross sectional view showing the structure of a heating element in the thermal head of the invention.

The platen roller 60 rotates at a specified image recording speed in the direction shown by the arrow in FIG. 1 while holding the thermal material A in a specified position and transports the thermal material A in the auxiliary scanning direction which is perpendicular to the main scanning direction and is shown by the arrow X in FIG. 2.

The cleaning roller pair 56 comprises an adhesive rubber roller made of an elastic material (upper side in the drawing) and a non-adhesive roller. The adhesive rubber roller picks up dirt and other foreign matter that has been deposited on the thermal recording layer of the thermal material A, thereby preventing the dirt from being deposited on the glaze or otherwise adversely affecting the image recording operation.

Before the thermal material A is transported to the recording section 20, the support member 68 in the illustrated recording apparatus 10 has pivoted to UP position so that the glaze of the thermal head 66 is in the standby position just before coming into contact with the platen roller 60.

When the transport of the thermal material A by the regulating roller pair 52 starts, said material is subsequently pinched by the cleaning roller pair 56 and transported as it is guided by the guide 58. When the forward end of the thermal material A has reached the record START position (i.e., corresponding to the glaze), the support member 68 pivots to DOWN position and the thermal material A becomes pinched between the glaze and the platen roller 60 such that the glaze is pressed onto the recording layer while the thermal material A is transported in the auxiliary scanning direction by means of the platen roller 60 and other parts as it is held in a specified position by the platen roller 60.

During this transport, the respective heating elements on the glaze are actuated imagewise to perform thermal recording on the thermal material A.

After the end of thermal recording, the thermal material A as it is guided by the guide 62 is transported by the platen roller 60 and the transport roller pair 63 to be ejected into a tray 72 in the ejecting section 22. The tray 72 projects exterior to the recording apparatus 10 via the outlet 74 formed in the housing 28 and the thermal material A carrying the recorded image is ejected via the outlet 74 for takeout by the operator.

FIG. 2 is a schematic cross section of the glaze (or heating element) of the thermal head 66. As shown, to form the glaze, the top of a substrate 80 (which is shown to face down in FIG. 2 since the thermal head 66 is pressed downward against the thermal material A) is overlaid with a glaze layer (heat accumulating layer) 82 which, in turn, is overlaid with a heater (heat-generating resistor) 84 which, in turn, is overlaid with electrodes 86 which, in turn, is overlaid with a protective film which protects the heater 84 and optionally the electrodes 86 and other parts.

The illustrated protective film is composed of three layers: a ceramic-based lower protective layer 88 superposed on the heater 84 and the electrodes 86, an intermediate protective layer 89 formed on the lower protective layer 88 and a carbon-based upper protective layer, for example, carbon protective layer 90 (preferably diamond-like carbon (DLC) protective layer) which is formed on the intermediate protective layer 89. The intermediate protective layer forms a characteristic portion of the invention.

The thermal head 66 of the invention has essentially the same structure as known versions of thermal head except for the protective film. Therefore, the arrangement of other layers and the constituent materials of the respective layers are not limited in any particular way and various known versions may be employed. Specifically, the substrate 80 may be formed of various electrical insulating materials including heat-resistant glass and ceramics such as alumina, silica and magnesia; the glaze layer 82 may be formed of heat-resistant glass, heat resistant resins including polyimide resin and the like; the heater 84 may be formed of heat-generating resistors such as Nichrome (Ni—Cr), tantalum metal and tantalum nitride; and the electrodes 86 may be formed of electrically conductive materials such as aluminum, gold, silver and copper.

Heating elements on the glaze are known to be available usually in two types, one being of a thin-film type which is formed by a "thin-film" process such as vacuum evaporation, chemical vapor deposition (CVD) or sputtering and a photoetching technique, and the other being of a thick-film type which is formed by "thick-film" process comprising the steps of printing (e.g., screen printing) and firing and an etching technique. The thermal head 66 for use in the invention may be formed by either method.

As described above, the illustrated thermal head 66 comprises a protective film composed of three layers: the carbon protective layer 90, the intermediate protective layer 89 and the lower protective layer 88. More preferred results can be obtained by the lower protective layer in various aspects including resistance to wear, resistance to corrosion and resistance to corrosion wear. A thermal head having a higher durability and a long service life can be thus realized.

The material of the lower protective layer 88 to be formed on the thermal head 66 of the invention is not limited in any particular way and the lower protective layer 88 may be formed of a variety of ceramic-based materials as long as they have sufficient heat resistance, corrosion resistance and wear resistance to serve as the protective film of the thermal head.

Specific materials include silicon nitride ($Si_3N_4$), silicon carbide (SiC), tantalum oxide ($Ta_2O_5$), aluminum oxide ($Al_2O_3$), SIALON (Si—Al—O—N), LASION (La—Si—O—N), silicon oxide ($SiO_2$), aluminum nitride (AlN), boron nitride(BN), selenium oxide (SeO), titanium nitride (TiN), titanium carbide (TiC), titanium carbide nitride (TiCN), chromium nitride (CrN) and mixtures thereof. Among others, nitrides and carbides are preferably used in various aspects such as easy film deposition, reasonability in manufacturing including manufacturing cost, balance between mechanical wear and chemical wear. Silicon nitride, silicon carbide and SIALON are more preferably used. Additives such as metals and semi-metals to be described below may be incorporated in small amounts into the lower protective layer 88 to adjust physical properties thereof.

Methods of forming the lower protective layer 88 are not limited in any particular way and known methods of forming ceramic films (layers) may be employed by applying the aforementioned thick-film and thin-film processes and the like.

The thickness of the lower protective layer 88 is not limited to any particular value but it ranges preferably from about 0.2 μm to about 20 μm, more preferably from about 2 μm to about 15 μm. If the thickness of the lower protective layer 88 is within the stated ranges, preferred results are obtained in various aspects such as the balance between wear resistance and heat conductivity (that is, recording sensitivity).

The lower protective layer 88 may comprise multiple sub-layers. In this case, multiple sub-layers may be formed of different materials or multiple sub-layers different in density may be formed of one material. Alternatively, the two methods may be combined to obtain sub-layers.

The thermal head 66 of the invention has a protective film comprising the lower protective layer 88, the intermediate protective layer 89 deposited on the lower protective layer 88, and the carbon-based protective layer 90 deposited on the intermediate protective layer. Thus, excellent wear resistance and corrosion resistance are imparted to the carbon protective layer 90, which can be protected to some extent from cracking and peeling due to the heat shock and thermal stress as described above.

When forming only the carbon protective layer 90 on the underlying silicon nitride layer, the carbon protective layer 90 does not have a sufficient adhesion to the lower layer (the lower protective layer 88 in the illustrated case) to be protected from cracking and peeling which may be caused by a stress due to a difference in coefficient of thermal expansion between the two layers, a mechanical impact due to a foreign matter or other factors.

Under these circumstances, it has been found that the adhesion of the lower protective layer 88 to the carbon protective layer 90 and the shock absorption of the protective film are significantly improved by providing the three-layer film also comprising the intermediate protective layer 89 between the lower protective layer 88 and the carbon protective layer 90. The durability of the thermal head 66 has been thus improved.

As described above, the carbon protective layer 90 having very high chemical s tability can also protect the ceramic-based lower protective layer 88 from chemical corrosion to thereby prolong the service life of the thermal head. Therefore, the thermal head 66 of the invention has not only the respective properties as described above which were improved by providing the intermediate protective layer 89, but also a sufficient durability to exhibit high reliability over an extended period of time, thereby ensuring that the thermal recording of high-quality images is consistently performed over an extended period of operation.

Especially, when recording under high-energy and high-pressure conditions on thermal films using a highly rigid substrate such as a polyester film or the like as in the aforementioned medical use, the thermal head also has a sufficient durability to exhibit high reliability over an extended period of time.

The intermediate protective layer 89 formed on the thermal head 66 of the invention is preferably based on at least one component selected from the group consisting of metals in Group IVA (titanium group), Group VA (vanadium group) and Group VIA (chromium group) of the periodic table, as well as silicium (Si) and germanium (Ge) in such aspects as the adhesion between the upper carbon protective layer 90 and the lower protective layer 88 and the durability of the carbon protective layer 90.

Preferred specific examples include Si, Ge, titanium (Ti), tantalum (Ta), molybdenum (Mo) and mixtures thereof. Among others, Si and Mo are more preferably used in the binding with carbon and other aspects. Most preferably, Si is used.

Methods of forming the intermediate protective layer 89 are not limited in any particular way and any known film deposition methods may be used in accordance with the material of the intermediate protective layer 89 by applying the aforementioned thick-film and thin-film processes and the like. A preferred method includes sputtering, but plasma-assisted CVD is also available with advantage.

The intermediate protective layer 89 may also comprise multiple sub-layers. In this case, multiple sub-layers may be formed of different materials or multiple sub-layers different in density may be formed of one material. Alternatively, the two methods may be combined to obtain sub-layers.

Prior to forming the intermediate protective layer 89, lapping treatment and etching treatment are preferably performed on the surface of the lower protective layer 88 to thereby roughen the surface thereof until the surface roughness represented by Ra reaches a specified range.

Thus, the adhesion between the lower protective layer 88 and the intermediate protective layer 89 and the adhesion between the intermediate protective layer 89 and the carbon protective layer 90 can be further improved, whereupon the thermal head can have more improved durability.

Specifically, the surface treatment is preferably performed to obtain the Ra value of 1 nm to 0.4 μm, more preferably 1 nm to 0.05 μm. When the Ra value is less than 1 nm, the adhesion is not particularly improved by the surface treatment. When the Ra value is more than 0.4 μm, the surface of the carbon protective layer 90 formed on the intermediate protective layer 89 has irregularities which may bring about undesired wear of the thermal head 66. The surface treatment must be performed so that the Ra value can be smaller than the thickness value of the lower protective layer 88. It should be noted that the thermal head 66 of the invention would have of course a sufficient durability without the lapping or etching treatment as described above.

The Ra value as used therein refers to the average roughness in center line. The surface geometry of the lower protective layer 88 was measured two-dimensionally to obtain a roughness curve, from which a roughness portion to be measured and having a length "l" was extracted in the direction of its center line. The value calculated by the following equation (1) was used as the Ra value, based on the roughness curve expressed by y=f(x) in which the center line in the extracted portion is taken on the X-axis, and the direction in the longitudinal magnification on the Y-axis. Alternatively, the surface geometry may be measured tri-dimensionally to obtain a roughness curved surface expressed by z=f(x, y), from which a portion having a surface "s" is extracted and the value calculated by the following equation (2) may be used.

$$Ra=1/l\int_0^l|f(x)|dx \quad (1)$$

$$Ra=1/s\int\int|f(x,y)|dxdy \quad (2)$$

Surface treatment methods are not limited in any particular way and known various methods may be employed, as far as the above Ra value is obtained. The lapping treatment is preferably followed by the etching treatment.

In this case, the surface of the lower protective layer 88 is roughened by the lapping treatment to a specified roughness to thereby obtain a larger surface area. The surface susceptible to oxidation by oxygen in the atmosphere is then removed by the etching treatment. The adhesion of the lower protective layer 88 to the intermediate protective layer 89 and the upper protective layer 90 can be further improved by the relatively simple method as described above.

When performing the lapping treatment, known lapping sheets may be used to grind the lower protective layer 88 of the thermal head 66 mechanically or by manual operation. In mechanical grinding, lapping sheets may be passed through the apparatus, while being kept in contact with the lower protective layer 88 of the thermal head 66. The type of the lapping sheets is not particularly limited, as far as the above Ra value is obtained. Lapping sheets are preferably of #1000 to #20000, more preferably of #4000 to #15000. The etching treatment may be performed using a sputtering apparatus or the like which will be described below.

On the thus treated lower protective layer 88 is formed the intermediate protective layer 89, after which the carbon-based protective layer 90 is formed thereon.

The illustrated thermal head 66 uses the carbon protective layer 90 exemplified by the DLC protective layer as the carbon-based protective layer. The carbon-based protective layer of the invention refers to a carbon protective layer containing more than 50 atm % of carbon. The carbon-based protective layer is preferably a carbon protective layer comprising carbon and inevitable impurities, more preferably a high-purity carbon protective layer having extremely reduced or no inevitable impurities, for example the DLC protective layer.

The inevitable impurities include residual gases in the vacuum chamber exemplified by oxygen and gases used during the process such as argon (Ar). The content of the gaseous components incorporated into the carbon protective layer is suitably as low as possible, preferably not more than 2 atm %, more preferably not more than 0.5 atm %.

According to the invention, the components to be incorporated in addition to carbon to form the carbon-based protective layer include advantageously elements such as hydrogen, nitrogen and fluorine, and semi-metals and metals such as Si, Ti, Zr, Hf, V, Nb, Ta, Cr, Mo and W. In the case of hydrogen, nitrogen and fluorine, the content thereof in the carbon-based protective layer is preferably less than 50 atm %, and in the case of the abovementioned semi-metals and metals such as Si, Ti and the like, the content thereof is preferably not more than 20 atm %.

We will now describe the carbon protective layer 90 as a typical example of the carbon-based protective layer, but it is to be understood that the description can be also applied to other carbon-based protective layers.

As described above, the carbon protective layer 90 having very high chemical stability can protect the lower protective layer 88 from chemical corrosion to thereby prolong the service life of the thermal head.

The hardness of the carbon protective layer 90 is not limited to any particular value as far as the carbon protective layer 90 has a sufficient hardness to serve as the protective film of the thermal head. Thus, the carbon protective layer 90 having a Vickers hardness of from 3000 kg/mm$^2$ to 5000 kg/mm$^2$ is advantageously illustrated. The hardness may be constant or varied in the thickness direction of the carbon protective layer 90. In the latter case, the hardness variation may be continuous or stepwise.

Methods of forming the carbon protective layer 90 are not limited in any particular way and known thick- and thin-film processes may be employed. Preferred examples include the plasma-assisted CVD using a hydrocarbon gas as a reactive gas to form a hard carbon film and the sputtering of a carbonaceous material (e.g., sintered carbon or glassy carbon) as a target to form a hard carbon film.

The carbon protective layer 90 may be formed with heating. In this method, the adhesion of the carbon protective layer 90 to the intermediate protective layer 89 and the lower protective layer 88 can be further improved, and more excellent durability can be imparted to the carbon protective layer 90 which is protected from cracking and peeling caused by a heat shock due to annealing of the heaters and a mechanical impact due to a foreign matter entered between the thermal material and the thermal head during recording, as well as from change of properties and wear-out of the carbon layer due to high power recording.

The heating temperature is preferably in the range of from 50 to 400° C., more preferably in the temperature range in which the thermal head 66 is used, for example, from 100 to 250° C. If the temperature is within the defined ranges, the adhesion of the carbon protective layer 90 to the intermediate protective layer 88 and the durability of the carbon protective layer 90 itself are most preferred.

Preferred heating methods include but are not limited to a method in which a heater is provided on the upper surface of a substrate holder in a film deposition apparatus such as a sputtering apparatus or a plasma-assisted CVD apparatus and a substrate put on the heater is heated, and another method in which the thermal head 66 is energized to generate heat in the thermal head 66 itself to thereby heat the surface of the intermediate protective layer 88. Other various heating methods may of course be used.

The intermediate protective layer 89 and the carbon protective layer 90 are not limited in thickness to any particular values. The intermediate protective layer 89 has preferably a thickness of from 0.05 $\mu$m to 2 $\mu$m, more preferably from 0.1 $\mu$m to 1 $\mu$m. The carbon protective layer 90 has preferably a thickness of from 0.5 $\mu$m to 5 $\mu$m, more preferably from 1 $\mu$m to 3 $\mu$m.

In the case of the intermediate protective layer 89 which is much thicker than the carbon protective layer 90, cracking and peeling may often take place in the intermediate protective layer 89. When the intermediate protective layer 89 is much thinner than the carbon protective layer 90, the lapping treatment and the etching treatment can not ensure a sufficient thickness to exclude the irregularities formed on the surface of the lower protective layer 88. Therefore, if the thicknesses of the intermediate protective layer 89 and the carbon protective layer 90 are within the stated ranges, the adhesion of the intermediate protective layer 89 to the lower protective layer 88 and the shock absorption thereof as well as the functions of the carbon protective layer 90 including durability can be realized in a well balanced manner.

Figure 3:
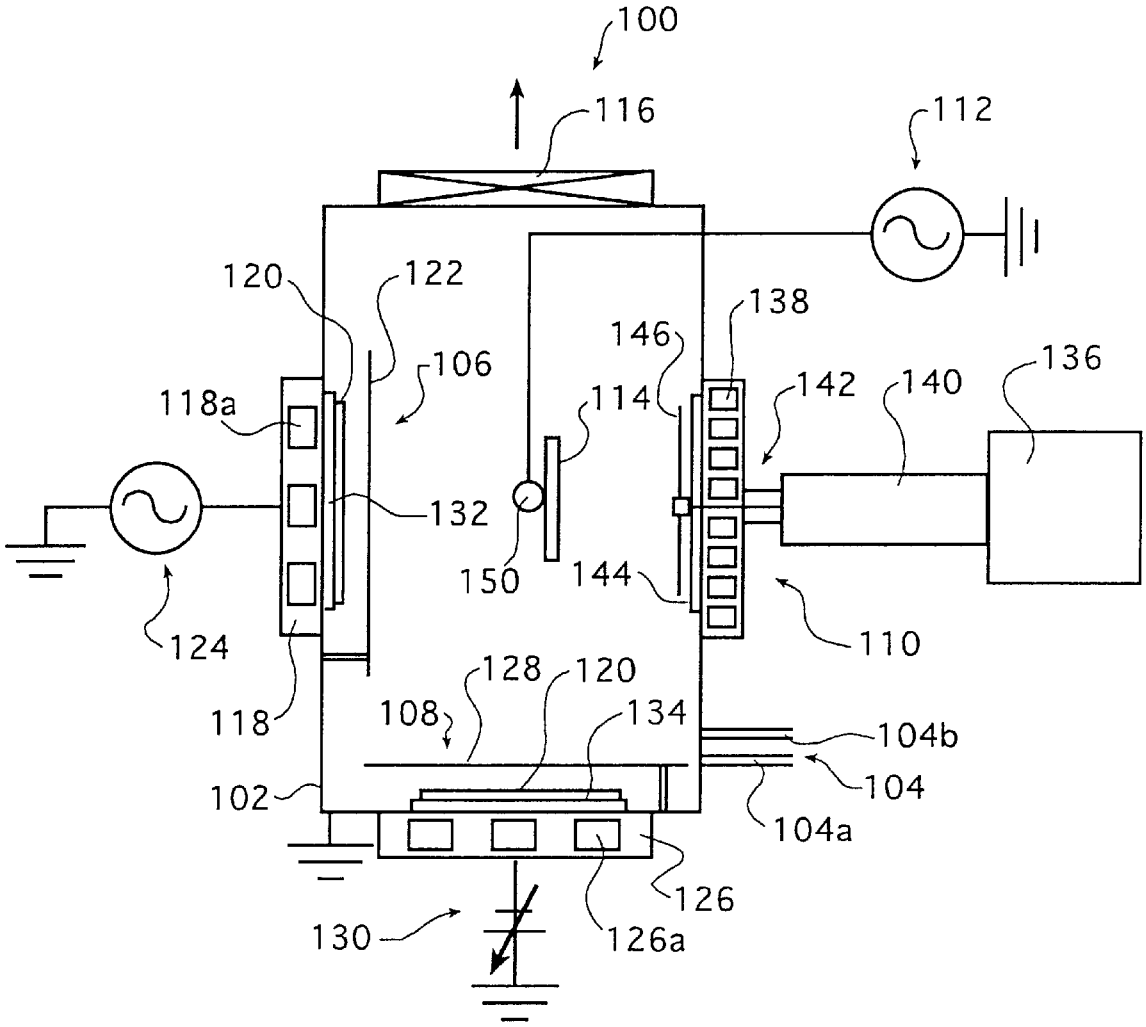
FIG. 3 shows the concept of an exemplary film deposition apparatus for use in fabricating the thermal head of the invention.

FIG. 3 shows the concept of a film deposition apparatus used to form the intermediate protective layer 89 and the carbon protective layer 90.

The illustrated film deposition apparatus generally indicated by 100 in FIG. 3 comprises a vacuum chamber 102, a gas introducing section 104, first sputter means 106, second sputter means 108, plasma generating means 110, a bias source 112 and a substrate holder 114 as the basic components.

The film deposition apparatus 100 comprises three film deposition means located in the system or the vacuum chamber 102, the two being performed by sputtering and the other by plasma-assisted CVD. The intermediate protective layer 89 and the carbon protective layer 90 can be successively deposited on the film deposition substrate of the thermal head 66 by sputtering using different targets or the combination of sputtering with plasma-assisted CVD, without the necessity of taking the thermal head 66 out of the system. Therefore, a plurality of different layers can be successively deposited on the substrate by means of the film deposition apparatus 100, without releasing the atmospheric pressure in the system, whereupon the fabrication of thermal head can be performed with a high efficiency.

The vacuum chamber 102 is preferably formed of a nonmagnetic material such as SUS 304 in order to keep unperturbed the magnetic field of cathodes 118 and 126 to be described below or the magnetic field generated for plasma generation.

Preferably, the vacuum chamber 102 which is used to form the intermediate protective layer 89 and the carbon protective layer 90 on the thermal head 66 of the invention presents such a vacuum seal property that an ultimate pressure of $2\times10^{-5}$ Torr or below, preferably $5\times10^{-6}$ Torr or below, is reached by initial pump-down whereas an ultimate pressure between $1\times10^{-4}$ Torr and $1\times10^{-2}$ Torr is reached during film deposition.

Vacuum pump-down means 116 is provided for the vacuum chamber 102 and a preferred example is the combination of a rotary pump, a mechanical booster pump and a turbomolecular pump; pump-down means using a diffusion pump or a cryogenic pump may be suitably used instead of the turbomolecular pump. The performance and number of vacuum pump-down means 116 may be determined as appropriate for various factors including the capacity of the vacuum chamber 102 and the flow rate of a gas used during film deposition. In order to increase the pumping speed, various adjustment designs may be employed, such as bypass pipes that provide for evacuation resistance adjustment and orifice valves which are adjustable in the degree of opening.

Those sites of the vacuum chamber 102 where plasma develops or an arc is produced by plasma generating electromagnetic waves may be covered as required with an insulating member, which may be made of insulating materials including MC nylon, Teflon (PTFE), polyphenylene sulfide (PPS), polyethylene naphthalate (PEN) and polyethylene terephthalate (PET). If PEN or PET is used, care must be taken to insure that the degree of vacuum will not decrease upon degassing of such insulating materials.

The gas introducing section 104 consists of two parts 104*a* and 104*b*, the former being a site for introducing a plasma generating gas and the latter for introducing a reactive gas for use in the plasma-assisted CVD, into the vacuum chamber 102 through stainless steel pipes or the like that are vacuum sealed with O-rings or the like at the inlet. The amounts of the gases being introduced are controlled by known means such as a mass flow controller.

Both gas introducing parts 104*a* and 104*b* are preferably optimized to displace the introduced gases to the neighborhood of the plasma-generating region in the vacuum chamber 102 as far as possible and not to affect adversely the distribution of the generated plasma. The blowout position, particularly that of the reactive gas introducing part 104*b*, has a certain effect on the thickness profile of the layers to be formed and, hence, it is preferably optimized in accordance with various factors such as the geometry of the substrate (the glaze 82 of the thermal head 66).

Examples of the plasma generating gas for producing the intermediate protective layer 89 and the carbon protective layer 90 are inert gases such as helium, neon, argon, krypton and xenon, among which argon gas is used with particular advantage because of its price and easy availability. Examples of the reactive gas for producing the carbon protective layer 90 are the gases of hydrocarbon compounds such as methane, ethane, propane, ethylene, acetylene and benzene. Examples of the reactive gas for producing the intermediate protective layer 89 are various gases including materials used to form the intermediate protective layer 89.

It is required with the gas introducing parts 104*a* and 104*b* that the sensors in the mass flow controllers be adjusted in accordance with the gases to be introduced.

To effect sputtering, a target 120 to be sputtered is placed on each of the respective cathodes 118 and 126, which are rendered at negative potential and a plasma is generated on the surface of the target 120, whereby atoms are struck out of the target 120 and deposit on the surface on the opposed substrate (i.e., the glaze of the thermal head 66) to form the film.

The first sputter means 106 and the second sputter means 108 are intended for sputtering film deposition on the surface of the substrate. The former comprises the cathode 118, the area where the target 120 is to be placed, a shutter 122, a radio-frequency (RF) power supply 124 and other components. The latter comprises the cathode 126, the area where the target 120 is to be placed, a shutter 128, a direct current (DC) power supply 130 and other components.

As seen from the above configuration, the first sputter means 106 and the second sputter means 108 have basically a similar configuration except that the power supply and the positions of the respective components are different. Therefore, we now describe a typical example in which the intermediate protective layer 89 is formed by means of the first sputter means 106 before the carbon protective layer 90 is formed by means of the second sputter means. However, the invention is in no way limited to the above case.

In the illustrated film deposition apparatus 100, in order to generate a plasma on the surface of the target 120, the RF power supply 124 is used when forming the intermediate protective layer 89 by means of the first sputter means 106, and the DC power supply 130 is used when forming the carbon protective layer 90 by means of the second sputter means 108.

When the RF power supply 124 is to be used in the first sputter means 106, a radio-frequency voltage is applied to the cathode 118 via a matching box so as to generate a plasma. The matching box performs impedance matching such that the reflected wave of the radio-frequency voltage is no more than 25% of the incident wave. A suitable power supply used as the RF power supply 124 may be selected from those in commercial use which produce outputs at 13.56 MHz or more, example, at twice or three times the frequency of 13.56 Hz, and having powers in the range of from about 1 kW to about 10 kW, preferably about 1 kW to about 5 kW which are necessary and sufficient to produce the intermediate protective layer 89. The geometry of the cathode 118 may be determined as appropriate for the geometry of the substrate.

On the other hand, when the DC power supply 130 is to be used in the second sputter means, the negative side of the DC power supply 130 is connected directly to the cathode 126, which is supplied with a DC voltage of −300 to −1,000 V. The DC power supply 130 has an output of about 1 to 10 kW and a device having the necessary and sufficient output to produce the carbon protective layer 90 may appropriately be selected. For anti-arc and other purposes, a DC power supply pulse-modulated for 2 to 20 kHz is also applicable with advantage.

In the illustrated film deposition apparatus 100, the intermediate protective layer 89 is formed by the first sputter means 106 which uses the RF power supply 124 for plasma generation, and the carbon protective layer 90 is formed by the second sputter means 108 which uses the DC power supply 130 for plasma generation. This is not the sole case of the invention, but the sputter means 106 and 108 may be reversed in position. Alternatively, the intermediate protective layer 89 and the carbon protective layer 90 may be formed by the second sputter means using the DC power supply 130 and the first sputter means 106 using the RF power supply 124, respectively. In this case, the film deposition may be performed, with the sputter means 106 and 108 being reversed in position. In addition, the same power supply, that is, the DC power supply or RF power supply may be used in both of the sputter means 106 and 108, one of which is used to form the intermediate protective layer 89 and the other to form the carbon protective layer 90.

It should be noted that, when forming a silicium-based intermediate protective layer 89, the RF power supply is preferably used as a sputtering power supply to generate a plasma on the surface of the target 120 made of monocrystalline Si or another material.

The target 120 may be secured directly to the cathode 118 with In-based solder or by mechanical fixing means but usually a backing plate 132 (or 134 in the second sputter means 108) made of oxygen-free copper, stainless steel or the like is first fixed to the cathode 118 and the target 120 is then attached to the backing plate 132 by the methods just described above. The cathode 118 and the backing plate 132 are adapted to be water-coolable so that the target 120 is indirectly cooled with water.

Preferred materials of the target 120 used to form the intermediate protective layer 89 include metals of the Groups IVA, VA and VIA and monocrystalline Ge and Si and the like. The target 120 used to form the carbon protective layer 90 is preferably made of sintered carbon, glassy carbon or the like. The geometry of the target 120 may be determined as appropriate for the geometry of the substrate.

Another method that can advantageously be employed to form the intermediate protective layer 89 and the carbon protective layer 90 is magnetron sputtering, in which magnets 118*a* (or 126*a*) such as permanent magnets or electromagnets are placed within the cathode 118 and a sputtering plasma is confined within a magnetic field formed on the surface of the target 120. Magnetron sputtering is preferred since it achieves high deposition rates.

The shape, position and number of the permanent magnets or electromagnets to be used and the strength of the magnetic field to be generated are determined as appropriate for various factors such as the thicknesses and thickness profiles of the intermediate protective layer 89 and the carbon protective layer 90 to be formed and the geometry of the target 120. Using permanent magnets such as Sm—Co and Nd—Fe—B magnets which are capable of producing intense magnetic fields is preferred for several reasons including the high efficiency of plasma confinement.

In the film deposition by the plasma-assisted CVD, the plasma generating means may utilize various discharges such as DC discharge, RF discharge, DC arc discharge and microwave ECR discharge, among which DC arc discharge and microwave ECR discharge have high enough plasma densities to be particularly advantageous for high-speed film deposition.

The illustrated film deposition apparatus 100 utilizes microwave ECR discharge as film deposition means of the intermediate protective layer 89 and the carbon protective layer 901 using the plasma-assisted CVD. The plasma generating means 110 comprises a microwave source 136, magnets 138, a microwave guide 140, a coaxial transformer 142, a dielectric plate 144 and a radial antenna 146 and the like.

In DC discharge, a plasma is generated by applying a negative DC voltage between the substrate and the electrode. The DC power supply for use in DC discharge has an output of about 1 to 10 kW and a device having the necessary and sufficient output to produce the carbon protective layer 90 may appropriately be selected. For anti-arc and other purposes, a DC power supply pulse-modulated for 2 to 20 kHz is also applicable with advantage.

In RF discharge, a plasma is generated by applying a radio-frequency voltage to the electrodes via the matching box, which performs impedance matching such that the reflected wave of the radio-frequency voltage is no more than 25% of the incident wave. A suitable RF power supply for RF discharge may be selected from those in commercial use which produce outputs at 13.56 MHz or more, for example, at twice or three times the frequency of 13.56 Hz, and having powers in the range from about 1 kW to about 10 kW, preferably about 1 kW to about 5 kW which are necessary and sufficient to perform the intended film deposition. A pulse-modulated RF power supply is also useful for RF discharge.

In DC arc discharge, a hot cathode is used to generate a plasma. The hot cathode may typically be formed of tungsten or lanthanum boride ($LaB_6$). DC arc discharge using a hollow cathode can also be utilized. A suitable DC power supply for use in DC arc discharge may be selected from those which produce outputs at about 10 to 50 A having powers in the range from about 1 kW to about 10 kW which are necessary and sufficient to perform the intended film deposition.

In microwave ECR discharge, a plasma is generated by the combination of microwaves and an ECR magnetic field and, as already mentioned, the illustrated film deposition apparatus 100 utilizes microwave ECR discharge for plasma generation.

The microwave source 136 may appropriately be selected from those in commercial use which produce outputs at 2.45 GHz having powers in the range from about 1 kW to 3 kW which are necessary and sufficient to produce the carbon protective layer 90 or the like.

To generate an ECR magnetic field, permanent magnets or electromagnets which are capable of forming the desired magnetic field may appropriately be employed and, in the illustrated case, Sm—Co magnets are used as the magnets 138. Consider, for example, the case of using microwaves at 2.45 GHz; since the ECR magnetic field has a strength of 875 G (gauss), the magnets 138 may be those which produce a magnetic field with intensities of 500 to 2,000 G in the plasma generating region.

Microwaves are introduced into the vacuum chamber 102 using the microwave guide 140, the coaxial transformer 142, the dielectric plate 144, etc. It should be noted that the state of magnetic field format ion and the microwave introducing path, both affecting the thickness profile of the carbon protective layer 90 or the like to be deposited, are preferably optimized to provide a uniform layer thickness.

The substrate holder 114 is used to fix the thermal head 66 in position. The film deposition apparatus 100 as shown in FIG. 3 comprises these three film deposition means. The substrate holder 114 is held on the rotary base 150 which rotates to move the substrate holder 114 so that the glaze on the substrate can be opposed to the respective film deposition means, that is, the sputter means 106 and 108, and the plasma generating means 110 by means of the plasma-assisted CVD. The geometry of the substrate holder 114 may be appropriately selected depending on the size of the substrate or the like. In addition, a heater may be provided on the upper surface of the substrate holder 114 to perform sputtering with heating.

The distance between the substrate and target 120 or the radial antenna 146 is not limited to any particular value and a distance that provides a uniform thickness profile may be set appropriately within the range from about 20 mm to about 200 mm.

As described above, the surface of the lower protective layer 88 which was subjected to the lapping treatment is preferably etched with a plasma before the intermediate protective layer 89 is formed. In addition, film deposition has to be performed with a negative bias voltage being applied to the substrate in order to obtain a hard film by the plasma-assisted CVD.

To do this, the bias source 112 which applies a radio-frequency voltage to the substrate is connected to the substrate holder 114 in the film deposition apparatus 100. The bias source 112 is used to apply a radio-frequency voltage to the substrate via the matching box. A suitable RF power supply may be selected from those in commercial use which produce outputs at 13.56 MHz having powers in the range from about 1 kW to about 5 kW.

The intensity of etching may be determined with the bias voltage to the substrate being used as a guide; usually, an optimal value may be selected from the range of −100 to −500 V. The etching may be performed before the carbon protective layer 90 is formed on the intermediate protective layer 89.

The radio-frequency self-bias voltage is preferably used in the plasma-assisted CVD. The self-bias voltage is in the range of −100 to −500 V.

In a preferred embodiment, the film deposition apparatus as shown in FIG. 3 comprises these three film deposition means: the sputter means 106 and 108, and the plasma generating means 110 used for plasma-assisted CVD. The thermal head 66 of the invention is not however limited to the one having the intermediate protective layer 89 and the protective layer 90 formed with the film deposition apparatus 100. Conventional film deposition apparatus may of course be used having only one sputter means or plasma generating means. In addition, various film deposition apparatus of different configuration are available in accordance with the intended layer-structure of the thermal head, as exemplified by a film deposition apparatus which comprises one sputter means and one plasma generating means, and a film deposition apparatus which comprises two or three sputter means or plasma generating means.

The specifications of the respective portions of the film deposition apparatus may need to correspond to those of the apparatus as described above.

On the foregoing pages, the thermal head of the invention has been described in detail but the present invention is in no way limited to the stated embodiments and various improvements and modifications can of course be made without departing from the spirit and scope of the invention.

As described above in detail, the present invention provides a thermal head having a protective film which has significantly reduced corrosion and wear, which is advantageously protected from cracking and peeling due to heat and mechanical impact and which allows the thermal head to have a sufficient durability to ensure that the thermal recording of high-quality images is consistently performed over an extended period of operation.

Especially, when recording under high-energy and high-pressure conditions on thermal films using a highly rigid substrate such as a polyester film or the like as in the aforementioned medical use, the thermal head also has a sufficient durability to exhibit high reliability over an extended period of time.

The invention will be further illustrated by means of the following specific examples.

EXAMPLE 1

A commercial thermal head (Model KGT-260-12MPH8 of KYOCERA CORP.) was used as the base. The thermal head has a silicon nitride ($Si_3N_4$) film formed in a thickness of 11 $\mu$m as a protective layer on the surface of the glaze and having a Ra value of 3 nm. Therefore, in Example 1, the silicon nitride film serves as the lower protective layer 88 on which the intermediate protective layer 89 is formed. The carbon protective layer 90 used as the upper protective layer is then formed on the intermediate protective layer 89.

The film deposition apparatus 100 as shown in FIG. 3 was used to form the intermediate protective layer 89 and the carbon protective layer 90 on the base thermal head as described above.

The film deposition apparatus 100 is further described below.

a. Vacuum Chamber 102

The vacuum chamber 102 made of SUS 304 and having a capacity of 0.5 $m^3$ was used; vacuum pump-down means 116 comprised one unit each of a rotary pump having a pumping speed of 1,500 L/min, a mechanical booster pump having a pumping speed of 12,000 L/min and a turbomolecular pump having a pumping speed of 3,000 L/sec. An orifice valve was fitted at the suction inlet of the turbomolecular pump to allow for 10 to 100% adjustment of the degree of opening.

b. Gas Introducing Section 104

A mass flow controller permitting a maximum flow rate of 100 to 500 sccm and a stainless steel pipe having a diameter of 6 mm were used to form two gas introducing parts 104*a* and 104*b*, the former being used for introducing a plasma generating gas and the latter being used for introducing a reactive gas. The joint between the stainless steel pipe and the vacuum chamber 102 was vacuum sealed with an O-ring.

Argon gas was used as a plasma generating gas when forming the intermediate protective layer 89 and the carbon protective layer 90 as described below.

c. First and Second Sputter Means 106, 108

The cathodes 118 and 126 used were in a rectangular form having a width of 600 mm and a height of 200 mm, with Sm—Co magnets being incorporated as the permanent magnets 118*a* and 126*a*. The backing plates 132 and 134 were rectangular oxygen-free copper members, which were attached to the cathodes 118 and 126 with In-based solder. The interior of the cathodes 118 and 126 was water-cooled to cool the magnets 118*a* and 126*a*, the cathodes 118 and 126 and the rear side of each of the backing plates 132 and 134.

The RF power supply 124 used in the first sputter means 106 was at negative potential capable of producing a maximal output of 5 kW, whereas the DC power supply 130 used in the second sputter means 108 was at negative potential capable of producing a maximal output of 8 kW. These DC power supplies were adapted to be capable of pulse modulation at frequencies in the range of 2 to 10 kHz.

d. Plasma Generating Means 110

The microwave source 136 oscillating at a frequency of 2.45 GHz and producing a maximal output of 1.5 kW was employed. The generated microwave was guided to the neighborhood of the vacuum chamber 102 by means of the microwave guide 140, converted in the coaxial transformer 142 and directed to the radial antenna 146 in the vacuum chamber 102.

The plasma generating part used was in a rectangular form having a width of 600 mm and a height of 200 mm.

A magnetic field for ECR was produced by arranging a plurality of Sm—Co magnets used as the magnets 138 in a pattern to conform to the shape of the dielectric plate 144.

e. Substrate Holder 114

The rotary base 150 was rotated to move the substrate holder 114 so that the substrate, (that is, the glaze 82 of the thermal head 66) fixed thereon is kept opposed to one of the targets 120 in the first and second sputter means 106 and 108 and the radial antenna 146 in the plasma generating means 110.

The distance between the substrate and each target 120 or the radial antenna 146 can be adjusted in the range of from 50 to 150 mm irrespective of the direction in which the substrate faces. The distance between the substrate and each target 120 was set to 100 mm when sputtering was used to form the intermediate protective layer 89 and the carbon protective layer 90 as described below. The distance between the substrate and the radial antenna 146 was set to 150 mm when plasma-assisted CVD was used to form the carbon protective layer 90.

In addition, the area of the substrate in which the thermal head was held was set at a floating potential in order to enable the application of an etching radio-frequency voltage. A heater was also provided on the surface of the substrate holder 114 for film deposition with heating.

f. Bias Source 112

An RF power supply was connected to the substrate holder 114 via the matching box.

The RF power supply had a frequency of 13.56 MHz and could produce a maximal output of 3 kW. It was also adapted to be such that by monitoring the self-bias voltage, the RF output could be adjusted over the range of −100 to −500 V.

In this apparatus 100, the bias source 112 also serves as the substrate etching means.

Fabrication of Thermal Head:

In the film deposition apparatus 100, the thermal head 66 was secured to the substrate holder 114 in the vacuum chamber 102 such that the glaze 82 of the thermal head 66 would be kept opposed to the target 120 positioned in the first sputter means 106. All areas of the thermal head other than those where the intermediate protective layer 89 was to be formed (namely, the non-glaze areas) were previously masked. After the thermal head was fixed in position, the vacuum chamber 102 was pumped down to an internal pressure of $5\times10^{-6}$ Torr.

With continued pump-down, argon gas was introduced through the gas introducing section 104 and the pressure in the vacuum chamber 102 was adjusted to $5.0\times10^{-3}$ Torr by means of the orifice valve fitted on the turbomolecular pump. Subsequently, a radio-frequency voltage was applied to the substrate and the lower protective layer 88 (silicon nitride film) was etched for 10 minutes at a self-bias voltage of −300 V.

After the end of etching, a monocrystalline silicium target and a sintered graphite member were fixed (i.e., attached by means of In-based solder) on the backing plate 132 in the first sputter means 106 and on the backing plate 134 in the second sputter means 108, respectively. Then, the vacuum chamber 102 was evacuated again and the argon gas flow rate and the orifice valve were adjusted so as to maintain the internal pressure in the vacuum chamber 102 at $5.0\times10^{-3}$ Torr, with the shutter 122 being closed.

Subsequently, with the internal pressure in the vacuum chamber 102 kept at the stated level, the RF power was raised to 2 kW and the shutter 122 was opened. The sputtering was performed until the intermediate protective layer 89 has a thickness of 0.2 μm. The intermediate protective layer 89 deposited in a thickness of 0.2 μm was thus formed. To control the thickness of the intermediate protective layer 89 being formed, the deposition rate was determined previously and the time required to reach a specified film thickness was calculated.

Then, the rotary base 150 was rotated to oppose the glaze to the target 120 (i.e. the sintered graphite member) in the second sputter means 108. The argon gas flow rate and the orifice valve were adjusted so as to maintain the internal pressure in the vacuum chamber 102 at $5.0\times10^{-3}$ Torr, and a DC power of 0.5 kW was applied to the target 120 for 5 minutes with the shutter 128 being closed.

Subsequently, with the internal pressure in the vacuum chamber 102 kept at the stated level, the DC power was raised to 5 kW and the shutter 128 was opened. The sputtering was performed until the carbon protective layer 90 has a thickness of 2 μm. A thermal head having the carbon protective layer 90 deposited in a thickness of 2 μm was thus obtained. To control the thickness of the carbon protective layer 90 being formed, the deposition rate was determined previously and the time required to reach a specified film thickness was calculated.

The same procedure was repeated to fabricate in total four samples of thermal head, except that a titanium target, a molybdenum target and a tungsten target were respectively used as the target 120 to be fixed on the backing plate 132 of the first sputter means 106 to thereby form the intermediate protective layer 89.

Evaluation of Performance:

Using the thus fabricated four samples of thermal head according to the present invention and 5000 sheets of thermal material of B4 size (dry image recording film CR-AT of Fuji Photo Film Co., Ltd.), thermal recording test was performed using the thermal recording apparatus shown in FIG. 1.

The results showed that the carbon protective layer 90 did not crack or peel off and scarcely worn out and that every sample of thermal head had a sufficiently excellent durability to record high quality images without density unevenness in a consistent manner.

EXAMPLE 2

The procedure of Example 1 was repeated to fabricate additional samples of thermal head except that prior to etching the lower protective layer 88, lapping sheets of #8000 (B4 size) were passed through the apparatus while being kept in contact with the lower protective layer 88 of the thermal head to thereby roughen the surface of the lower protective layer 88 until the Ra value reached 0.2 μm.

The abrasion with lapping sheets was performed by passing 10 lapping sheets through the thermal recording apparatus on which the base thermal head having the lower protective layer 88 previously formed was mounted. The surface geometry of the lower protective layer 88 was two-dimensionally measured in a plurality of points without cut-off by means of a feeler-type roughness measuring apparatus (P-1 from KLA-TENCOR LTD.) to obtain the Ra values referring to the surface roughness and the average of the Ra values in these points was calculated.

Performance of the thus obtained samples of thermal head was evaluated as in Example 1. These samples showed the results as excellent as or more excellent than in Example 1.

EXAMPLE 3

The procedure of Example 2 was repeated to fabricate additional samples of thermal head except that lapping sheets were used to roughen the surface of the lower protective layer 88 of the thermal head 66 until the Ra value reached 0.1 μm. Subsequently, performance was evaluated.

The thus obtained samples of thermal head also showed the results as excellent as or more excellent than in Example 1.

EXAMPLE 4

The procedure of Example 2 was repeated to fabricate additional samples of thermal head except that lapping sheets of #15000 were used to roughen the surface of the lower protective layer 88 of the thermal head 66 until the Ra value reached 0.005 μm. Subsequently, performance was evaluated.

The thus obtained samples of thermal head also showed the results as excellent as or more excellent than in Example 1.

EXAMPLE 5

The procedure of Example 1 was repeated to fabricate additional samples of thermal head 66 except that the carbon protective layer 90 was formed on the intermediate protective layer 89, while heating the whole of the substrate of the thermal head 66 at 100 to 250° C. Subsequently, performance was evaluated.

Specifically, a heater was provided on the upper surface of the substrate holder 114 and the substrate put on the heater was heated to thereby form the carbon protective layer 90.

The thus obtained samples of thermal head also showed the results as excellent as or more excellent than in Example 1.

EXAMPLE 6

The procedure of Example 1 was repeated to fabricate additional samples of thermal head except that the carbon protective layer 90 was formed, while heating the surface of the intermediate protective layer 89 at 200 to 450° C. by energizing the thermal head. Subsequently, performance was evaluated.

Specifically, a constant DC was applied to the common side, with the strobe of the driver IC in the thermal head being ON, to energize the thermal head 66 for heat generation, followed by heating of the surface of the intermediate protective layer 89 at a constant temperature to thereby form the carbon protective layer 90.

The thus obtained samples of thermal head also showed the results as excellent as or more excellent than in Example 1.

COMPARATIVE EXAMPLE 1

The procedure of Example 1 was repeated to fabricate additional samples of thermal head except that the intermediate protective layer 89 was not formed but the carbon protective layer 90 was directly formed on the lower protective layer 88. Subsequently, performance was evaluated.

The results showed the carbon protective layer 90 had cracked and peeled off before recording 5000 sheets.

EXAMPLE 7

The procedure of Example 1 was repeated to form the intermediate protective layer 89 having a thickness of 0.2 μm on the surface of the lower protective layer 88 of the thermal head as used in Example 1, except that a target was not used in the second sputter means 108.

The target 120 used in the first sputter means 106 is a monocrystalline silicium target.

Then, the rotary base 150 was rotated to oppose the glaze 66 to the radial antenna 146 in the plasma generating means 110, and the pressure in the vacuum chamber 102 was adjusted to $5.0\times10^{-3}$ Torr.

With continued pump-down, methane gas was introduced through the gas introducing part 104*a* and the pressure in the vacuum chamber 102 was adjusted to $5.0\times10^{-3}$ Torr by means of the orifice valve fitted on the turbomolecular pump. Subsequently, the microwave source 136 was driven to introduce each microwave into the vacuum chamber 102 to perform plasma-assisted CVD. Additional samples of thermal head having the carbon protective layer 90 formed in a thickness of 1 μm on the intermediate protective layer 89 were fabricated. To control the thickness of the carbon protective layer 90 being formed, the deposition rate was determined previously and the time required to reach a specified film thickness was calculated.

In addition, The same procedure was repeated to fabricate in total three samples of thermal head except that a titanium target and a molybdenum target were respectively used as the target in the first sputter means 106 to thereby form the intermediate protective layer 89.

Evaluation of Performance:

Using the thus fabricated three samples of thermal head and a thermal material, performance was evaluated as in Example 1 using the thermal recording apparatus shown in FIG. 1.

The results showed that in every sample of thermal head, the carbon protective layer 90 did not crack or peel off and scarcely worn out.

EXAMPLE 8

The procedure of Example 7 was repeated to fabricate additional samples of thermal head except that prior to etching the lower protective layer 88, lapping sheets of #8000 were passed through the apparatus while being kept in contact with the lower protective layer 88 of the thermal head to thereby roughen the surface of the lower protective layer 88 until the Ra value reached 0.2 μm. Subsequently, performance was evaluated. The sheets were passed through as in Example 2.

The thus obtained samples of thermal head showed the results as excellent as or more excellent than in Example 7.

EXAMPLE 9

The procedure of Example 7 was repeated to fabricate additional samples of thermal head except that lapping sheets were used to roughen the surface of the lower protective layer 88 of the thermal head 66 until the Ra value reached 0.1 μm. Subsequently, performance was evaluated.

The thus obtained samples of thermal head also showed the results as excellent as or more excellent than in Example 7.

EXAMPLE 10

The procedure of Example 7 was repeated to fabricate additional samples of thermal head except that lapping sheets of #15000 were used to roughen the surface of the lower protective layer 88 of the thermal head 66 until the Ra value reached 0.005 μm. Subsequently, performance was evaluated.

The thus obtained samples of thermal head also showed the results as excellent as or more excellent than in Example 7.

EXAMPLE 11

The procedure of Example 7 was repeated to fabricate additional samples of thermal head except that the carbon protective layer 90 was formed on the intermediate protective layer 89, while heating the whole of the substrate of the thermal head 66 at 100 to 250° C. Subsequently, performance was evaluated.

Specifically, a heater was provided on the upper surface of the substrate holder 114 and the substrate put on the heater was heated to thereby form the carbon protective layer 90.

The thus obtained samples of thermal head also showed the results as excellent as or more excellent than in Example 7.

EXAMPLE 12

The procedure of Example 7 was repeated to fabricate additional samples of thermal head except that the carbon protective layer 90 was formed, while heating the surface of the intermediate protective layer 89 at 200 to 450° C. by energizing the thermal head. Subsequently, performance was evaluated.

Specifically, a constant DC was applied to the common side, with the strobe of the driver IC in the thermal head being ON, to energize the thermal head 66 for heat generation, followed by heating of the surface of the intermediate protective layer 89 at a constant temperature to thereby form the carbon protective layer 90.

The thus obtained samples of thermal head also showed the results as excellent as or more excellent than in Example 7.

COMPARATIVE EXAMPLE 2

The procedure of Example 7 was repeated to fabricate additional samples of thermal head except that the intermediate protective layer 89 was not formed but the carbon protective layer 90 was directly formed on the lower protective layer 88. Subsequently, performance was evaluated.

The results showed the carbon protective layer 90 had cracked and peeled off before recording 5000 sheets.

These results clearly demonstrate the effectiveness of the thermal head of the present invention.

What is claimed is:

1. A thermal head having a protective film of a heater formed on said heater, said protective film comprising a ceramic-based lower protective layer composed of at least one sub-layer, and intermediate protective layer also composed of at least one sub-layer and formed on said lower protective layer, and a carbon-based upper protective layer formed on said intermediate protective layer, wherein said upper protective layer is the outermost layer of the protective film.

2. The thermal head according to claim 1, wherein said intermediate protective layer is based on at least one component selected from the group consisting of metals of the Groups IVA, VA and VIA, and Si and Ge.

3. A thermal head having a protective film of a heater formed on said heater, said protective film comprising a ceramic-based lower protective layer composed of at least one sub-layer, and intermediate protective layer also composed of at least one sub-layer and formed on said lower protective layer, and a carbon-based upper protective layer formed on said intermediate protective layer, wherein said intermediate protective layer has a thickness of from 0.05 $\mu$m to 5 $\mu$m.

4. The thermal head according to claim 1, wherein a surface of said lower protective layer is subjected to a lapping treatment and an etching treatment until said surface has a surface roughness value Ra of from 1 nm to 0.4 $\mu$m, before said intermediate protective layer is formed on said lower protective layer.

5. The thermal head according to claim 1, wherein said lower protective layer comprises at least one of a nitride and a carbide.

* * * * *